US005217422A

United States Patent [19]

Domzalski

[11] Patent Number: 5,217,422

[45] Date of Patent: Jun. 8, 1993

[54] COMPACT EXERCISE APPARATUS AND METHOD

[75] Inventor: Kenneth J. Domzalski, Cathedral City, Calif.

[73] Assignee: ZEL-X, Inc., Oakland, N.J.

[21] Appl. No.: 817,395

[22] Filed: Jan. 6, 1992

[51] Int. Cl.[5] ..... A63B 21/00

[52] U.S. Cl. ..... 482/138; 482/100; 482/137; 482/908

[58] Field of Search ..... 432/93-94, 432/97-103, 133, 135-138, 142, 908

[56] References Cited

U.S. PATENT DOCUMENTS

| | | | |
|---|---|---|---|
| 3,306,611 | 2/1967 | Gaul | 482/100 X |
| 3,708,167 | 1/1973 | Potgieter . | |
| 3,850,431 | 12/1974 | Winans . | |
| 3,917,262 | 11/1975 | Salkeld | 482/98 |
| 4,183,520 | 1/1980 | Chase . | |
| 4,317,566 | 3/1982 | Uyeda et al. . | |
| 4,336,934 | 6/1982 | Hanagan et al. | 482/97 X |
| 4,357,010 | 11/1982 | Telle | 482/97 |
| 4,470,596 | 9/1984 | Desiderio . | |
| 4,624,457 | 11/1986 | Silberman et al. . | |
| 4,691,916 | 9/1987 | Voris . | |
| 4,793,608 | 12/1988 | Mahnke et al. . | |
| 4,818,018 | 4/1989 | Yamasaki | 482/142 X |
| 4,826,157 | 5/1989 | Fitzpatrick | 482/142 X |
| 4,826,158 | 5/1989 | Fields, Jr. | 482/142 |
| 4,836,535 | 6/1989 | Pearson . | |
| 4,858,915 | 8/1989 | Szabo | 482/97 |
| 4,898,381 | 2/1990 | Gordon . | |
| 4,917,379 | 4/1990 | Maag | 482/97 |
| 4,986,538 | 1/1991 | Ish, III . | |
| 5,018,725 | 5/1991 | Cook . | |
| 5,080,351 | 1/1992 | Rockwell | 482/100 X |
| 5,116,297 | 5/1992 | Stonecipher | 482/137 X |

*Primary Examiner*—Robert Bahr
*Attorney, Agent, or Firm*—John S. Christopher

[57] ABSTRACT

A compact exercise apparatus for use in performing a plurality of exercises having a resistive load is disclosed. A frame structure is provided for supporting the load and a mechanism is employed for moving the load from a first to a second position. A linkage arrangement is disposed between the moving mechanism and the load and includes a plurality of interconnected pivotably operably lever arms. The linkage arrangement is in multiple mounting communication with the moving mechanism at one of the interconnected lever arms. This combination of structure enables the proper biomechanical and kinesiological movement of each of the exercises and permits moving the load from the first position to the second position. In a preferred embodiment, a frame structure supports a movable weight stack and an exercise bar is utilized to move the load from a first to a second position. A lever arm linkage arrangement is disposed between the exercise bar and the weight stack and includes a plurality of interconnected lever arms operating through a corresponding plurality of pivot points. Each of the lever arms is adapted for multiple mounting communication with the exercise bar for enabling the proper biomechanical and kinesiological movement of each of the exercises and for moving the weight stack from said first to said second position.

16 Claims, 7 Drawing Sheets

372
368
120
360
364
226
224
228
100
350
334
340
338
322
214
222
104
110
316
320
324
318
112
148
236
266
130
332
326
106
216
102
220
341
254
258
232
256
284
116
350
336
114
218
242
118
180
330
234
124
178
108
162
146
314
312
308
144
304
354

COMPACT EXERCISE APPARATUS AND METHOD

BACKGROUND OF THE INVENTION

1. Field of the Invention

The present invention relates to exercise equipment. More specifically, the present invention relates to methods and apparatus for a multi-use, progressive resistance compact exercise machine for home use utilizing a lever arm linkage system.

2. Description of the Related Art

A literal explosion has taken pace in the field of physical fitness and particularly in the equipment utilized in fitness activities. It is generally accepted that certain benefits to ones health and well being flow to those who are physical fit. Many individuals who would otherwise reap these fitness benefits have busy schedules that prevent them from participating in fitness activities on a regular basis. Visiting gynamiums or other athletic centers is often time consuming and thus time inefficient to busy individuals.

In general, exercise machines permit simultaneous use by a number of individuals and are normally utilized in a commercial environment such as an athletic club. Therefore, initial disadvantages to a busy individual include access to the machine in a busy club environment and the related time consumption. In considering a general home fitness program, a plurality of exercise movements are normally included in exercise machine training programs. These movements are designed to exercise the major muscle groups. In reviewing the prior art as it relates to exercise machines, these exercise movements often require separate stations. Thus, it is generally necessary to have access to an athletic club or similar organization that provides exercise machines having multiple stations which permit executing the movements. The only alternative is to acquire a machine having multiple stations to perform the exercise movements at home. This alternative is generally cost prohibitive and space consuming.

It was recognized that a more convenient means for obtaining general fitness exercise on a regular basis for busy individuals was necessary. A solution to this problem appeared with the development of the home gym and other home use exercise devices. Various types of gyms and exercise devices which are intended to be utilized in residential and office environments have been known in the prior art. By way of example, several forms of such devices can be found in U.S. Pat. Nos. 3,708,167, 3,850,431, 4,183,520, 4,317,566, 4,470,596, 4,624,457, 4,691,916, 4,793,608, 4,836,535, 4,986,538, 4,898,381 and 5,018,725.

The majority of the exercising devices disclosed by the above-recited U.S. Patents teach a weight stack which is raised or lowered by a cable, belt, chain or similar means. Further, some of these patented devices teach the inclusion of a lever arm and a pivot point while others do not. A significant problem that exists with exercise machines of the prior art is that they include, if at all, only one lever arm operating through a single pivot point. Therefore, it is often not possible to emulate the proper biomechanical and kinesiological function adhering to a particular exercise that the device is designed to perform. Unfortunately, this situation increases the risk of user injury. Therefore, another common problem which results is that initial adjusting or reconfiguring of the exercising device, other than weight and seat adjustments, is required prior to use.

In those devices that exhibit only a single lever arm and a single pivot point, the number of exercises that can be performed biomechanically and kinesiologically correct is limited. In order to accomplish correct movement, the single pivot point must be adjustable on the main frame stanchion of the device. Such required adjusting is inconvenient and devices exhibiting a single pivot point tend to be balky.

Further, other devices include multiple stations which creates a space consideration problem or include multiple stations with a single weight stack which limits the use of the device to a single user at any time. Thus, attempted use by multiple individuals creates time consideration problems similar to those experienced in busy athletic clubs. Still other known home exercise devices, while occupying less space, are fitted with an elastic resistance means in lieu of a weight resistance load.

Thus, there is a need in the art for an improvement in home exercising devices which exhibits a construction that permits the proper biomechanical and kinesiological function adhering to a particular exercise which reduces the risk of injury, eliminates the necessity of adjusting or reconfiguring the device prior to use, permits completing a general fitness program on a compact machine suitable for home or office use, is less expensive than equivalent devices of the past and is space economical.

SUMMARY OF THE INVENTION

The need in the art is addressed by the compact exercise apparatus and method of the present invention. The invention is employed to perform a plurality of exercises and includes a resistive load. A frame structure is provided for supporting the load and a mechanism is employed for moving the load from a first to a second position. A linkage arrangement is disposed between the moving mechanism and the load and includes a plurality of interconnected pivotably operably lever arms. The linkage arrangement is in multiple mounting communication with the moving mechanism at one of the interconnected lever arms. This combination of structure enables the proper biomechanical and kinesiological movement of each of the exercises and permits moving the load from the first position to the second position.

In a preferred embodiment, a frame structure supports a movable weight stack and an exercise bar is utilized to move the load from a first to a second position. A lever arm linkage arrangement is disposed between the exercise bar and the weight stack and includes a plurality of interconnected lever arms operating through a corresponding plurality of pivot points. Each of the lever arms is adapted for multiple mounting communication with the exercise bar for enabling the proper biomechanical and kinesiological movement of each of the exercises and for moving the weight stack from said first to said second position.

DESCRIPTION OF THE INVENTION

Figure 2:
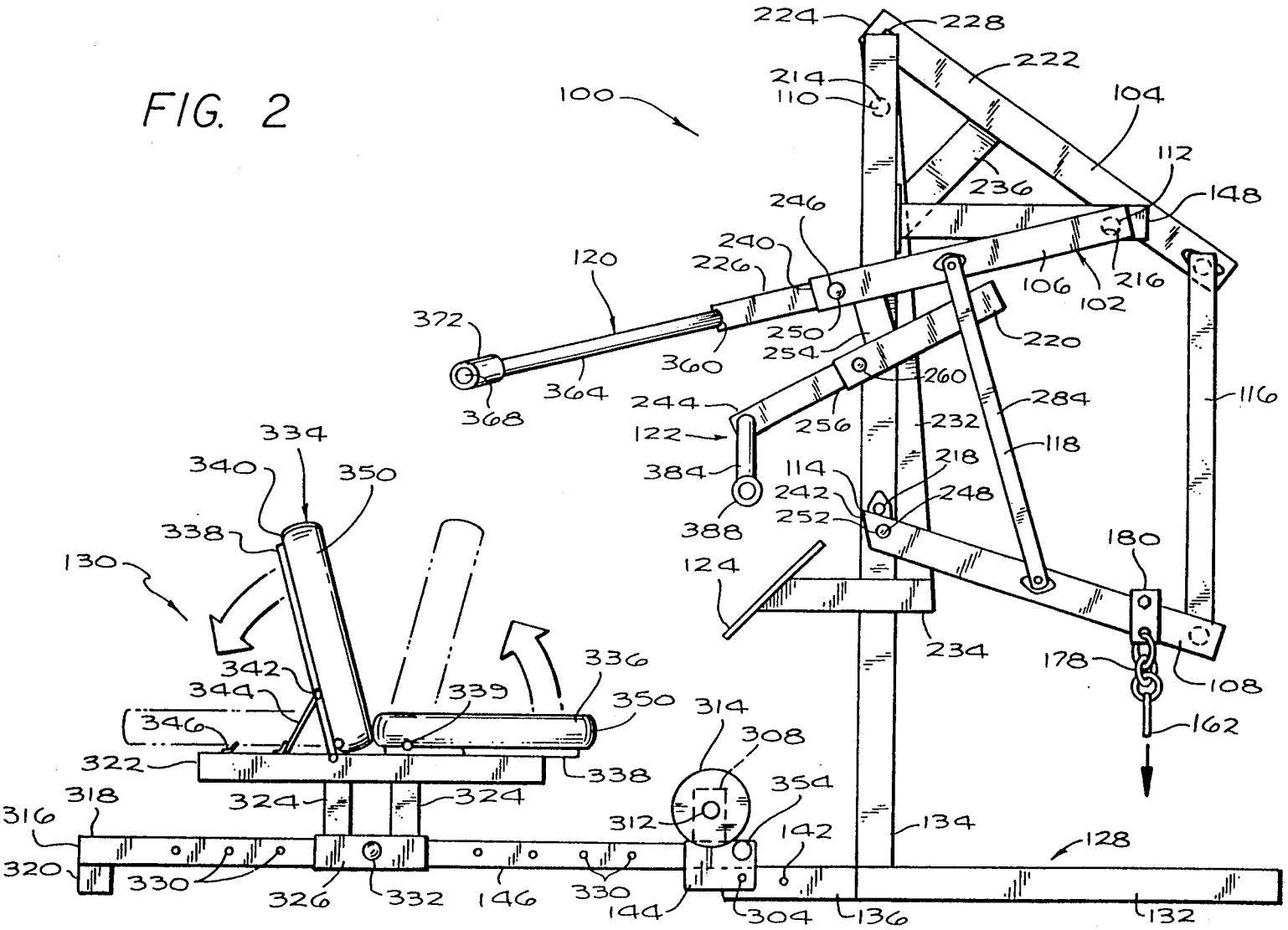
FIG. 2 is a side elevational view of the compact exercise apparatus of FIG. 1 showing more detail of the lever arm linkage system and the adjustable seat and the exercise bar in a second exercise position.

As shown in drawing FIG. 2 for purposes of illustration, the invention is embodied in a compact exercise apparatus 100 of the type having a linkage system 102 which includes a plurality of first, second and third lever arms 104, 106, 108, respectively, operating through a corresponding plurality of preset pivot points 110, 112, 114, respectively, with the plurality of lever arms interconnected by a pair of swivel bars 116, 118 for ensuring simultaneous operation of each of the lever arms upon the operation of any single lever arm without any adjustment required thereto.

A significant problem that exists with exercise machines of the prior art is that they include, if at all, only one lever arm operating through a single pivot point. Therefore, it is often not possible to emulate the proper biomechanical and kinesiological function adhering to a particular exercise that the device is designed to perform. This problem increases the risk of user injury. Therefore, a common problem of those devices that exhibit only a single lever arm and a single pivot point is that initial adjusting or reconfiguring of the exercising device, other than weight and seat adjustments, is required prior to use. Thus, in order to accomplish correct biomechanical and kinesiological movement, the single pivot point must be adjustable on the main frame stanchion of the device. Such required adjusting is inconvenient and devices exhibiting a single pivot point tend to be balky.

Further, other devices include multiple stations which creates a space consideration problem or include multiple stations with a single weight stack which limits the use of the device to a single user at any time. Thus, attempted use by multiple individuals creates time consideration problems similar to those experienced in busy athletic clubs. Still other known home exercise devices, while occupying less space, are fitted with an elastic resistance mechanism in lieu of a weight resistance load. Thus, a compact exercise machine which permits the completion of a general fitness program and is suitable for home and office use is desirable.

In accordance with the present invention, the plurality of interconnected lever arms 104, 106, 108 and the plurality of preset pivot points 110, 112, 114 cooperate to provide an adjustment free linkage system 102 which connects a first exercise bar 120, a second exercise bar 122 or a set of foot pedals 124 to a movable weight stack 126. Further, the cooperating lever arms and preset pivot points permit emulating the proper biomechanical and kinesiological movement of a plurality of exercises. Moveover, the compact exercise apparatus 100 exhibits a space economical design for serving as a convenient home and office gym to provide a general fitness program for those individuals with busy schedules at less expense than comparable exercise machines known in the past.

Figure 1:
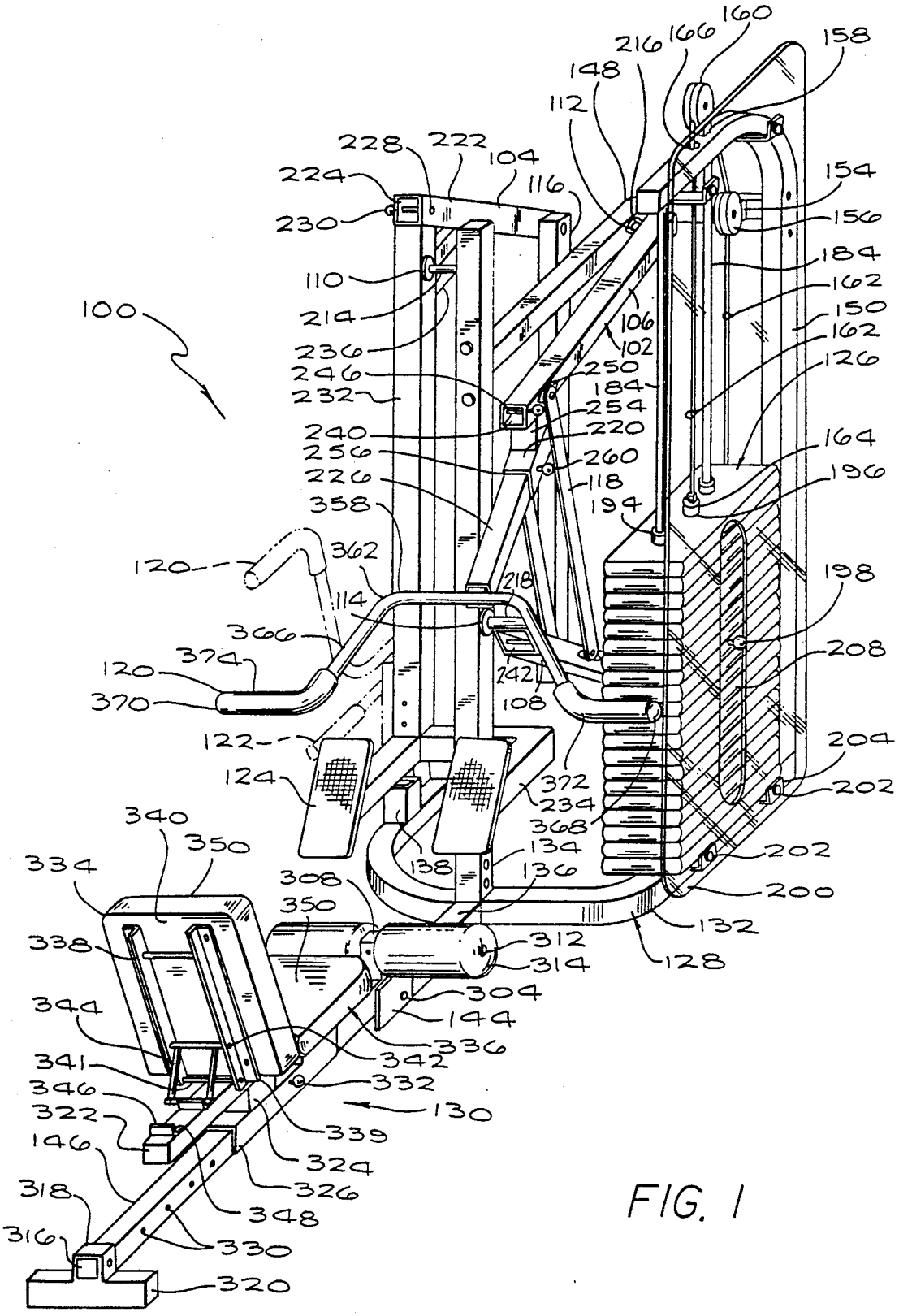
FIG. 1 is a perspective view of an illustrative embodiment of a compact exercise apparatus in accordance with the present invention showing the lever arm linkage system cooperating with a source of variable resistance and an exercise bar in a first exercise position.
Figure 8:
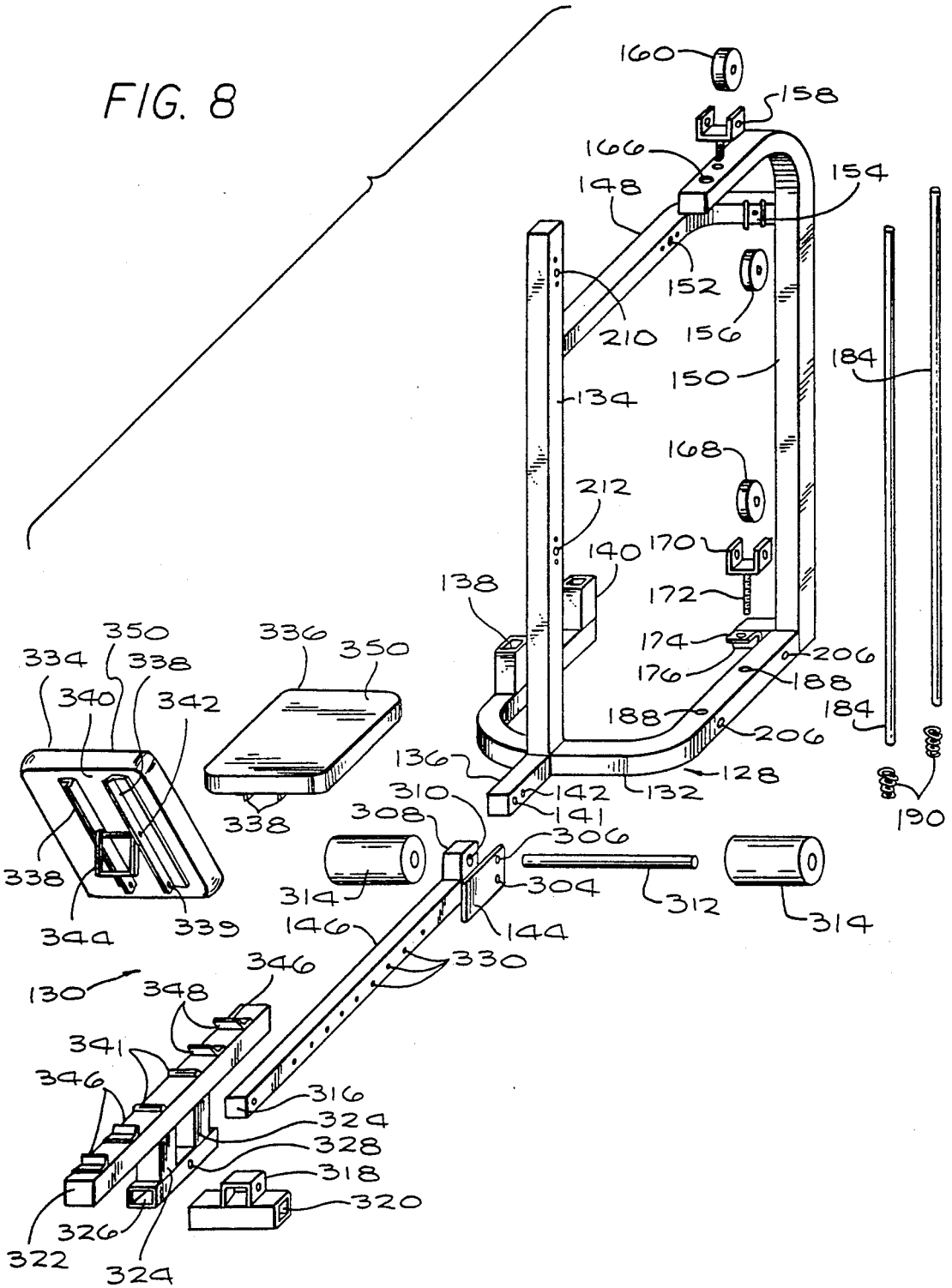
FIG. 8 is an exploded view of the seat and main frame assembly of the compact exercise apparatus of FIG. 1 showing an adjustable seat and a resistance pulley assembly.

The compact exercise apparatus 100 includes a frame 128 employed to support the structure of the apparatus and the weight stack 126 and to attach the preset pivot points 110, 112, 114 and a seat station 130 thereto. In particular, the frame 128 includes a U-shaped horizontal base 132 mounted orthogonally to an upright stanchion 134 as shown in FIGS. 1 and 8. The U-shaped base 132 includes an additional base member 136 for further supporting the upright stanchion 134 and for connecting to the seat station 130 also shown in FIGS. 1 and 8. The base 132 also includes a pair of storage slots 138 and 140 for stowage of the first and second exercise bars 120 and 122, respectively, when not in use.

The upright stanchion 134 includes the additional base member 136 for supporting the stanchion 134. The base member 136 includes a pair of penetrations 141 and 142 for interfacing with a U-brace 144 mounted at a terminal end of a main shaft 146 of the seat station 130. The base member 136 and the U-brace 144, in combination, are utilized for rotating the entire seat station 130 into a stowage position as will be discussed with reference to FIG. 3. Mounted orthogonally to the upright stanchion 134 is a cross member 148 which further supports the upright stanchion 134. The cross member 148 also includes a curved portion that mechanically communicates with a second stanchion 150 mounted at the back of the U-shaped base 132 as shown in FIG. 8. The inboard side of the cross member 148 includes several penetrations 152 for mounting a pillow block bearing which functions as the second pivot point 112 (shown in FIG. 1) and also a bracket 154 for mounting a second wheel 156.

Figure 3:
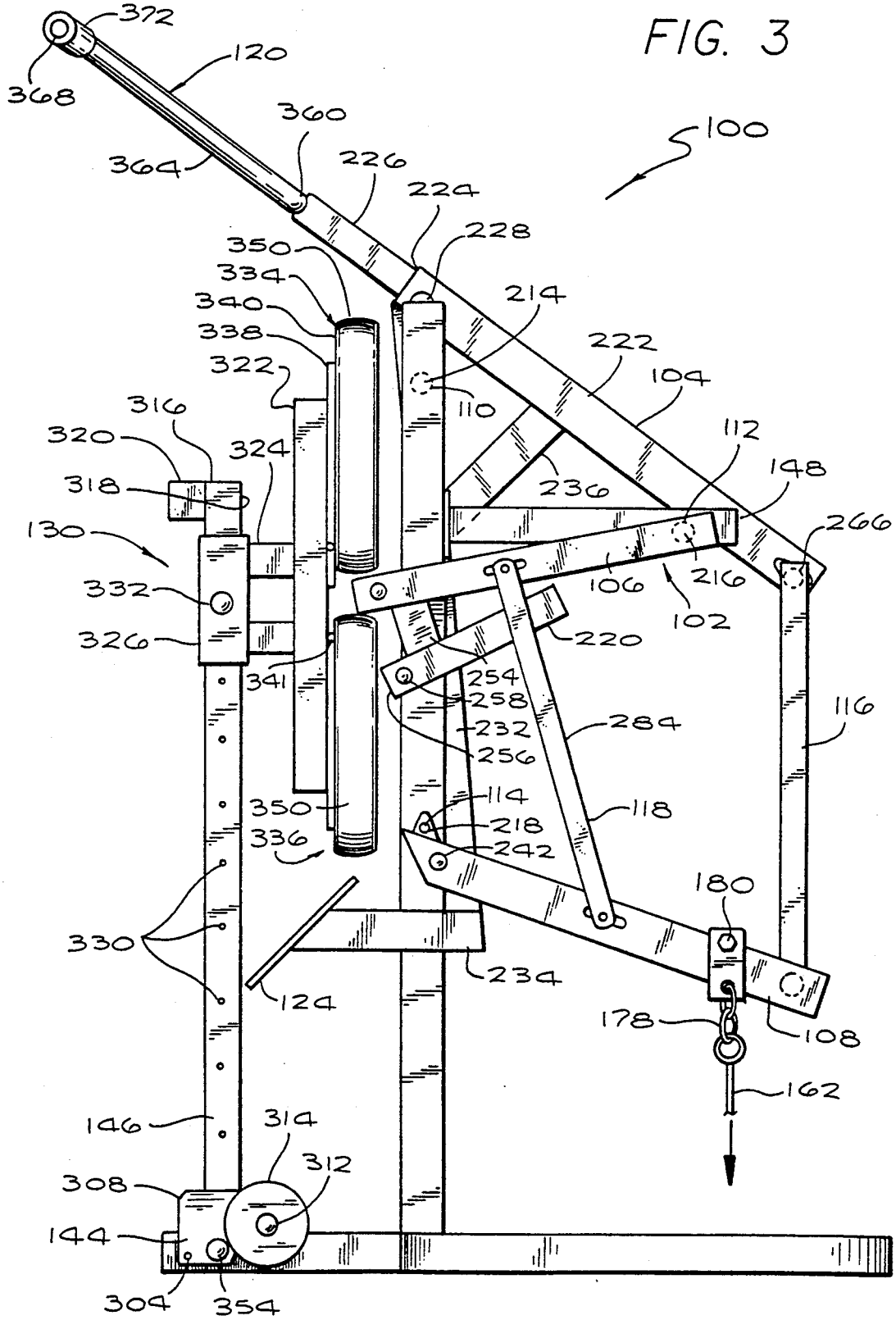
FIG. 3 is another side elevational view of the compact exercise apparatus of FIG. 1 showing the lever arm linkage system and the adjustable seat in the stowage position and the exercise bar in a third exercise position.
Figure 4:
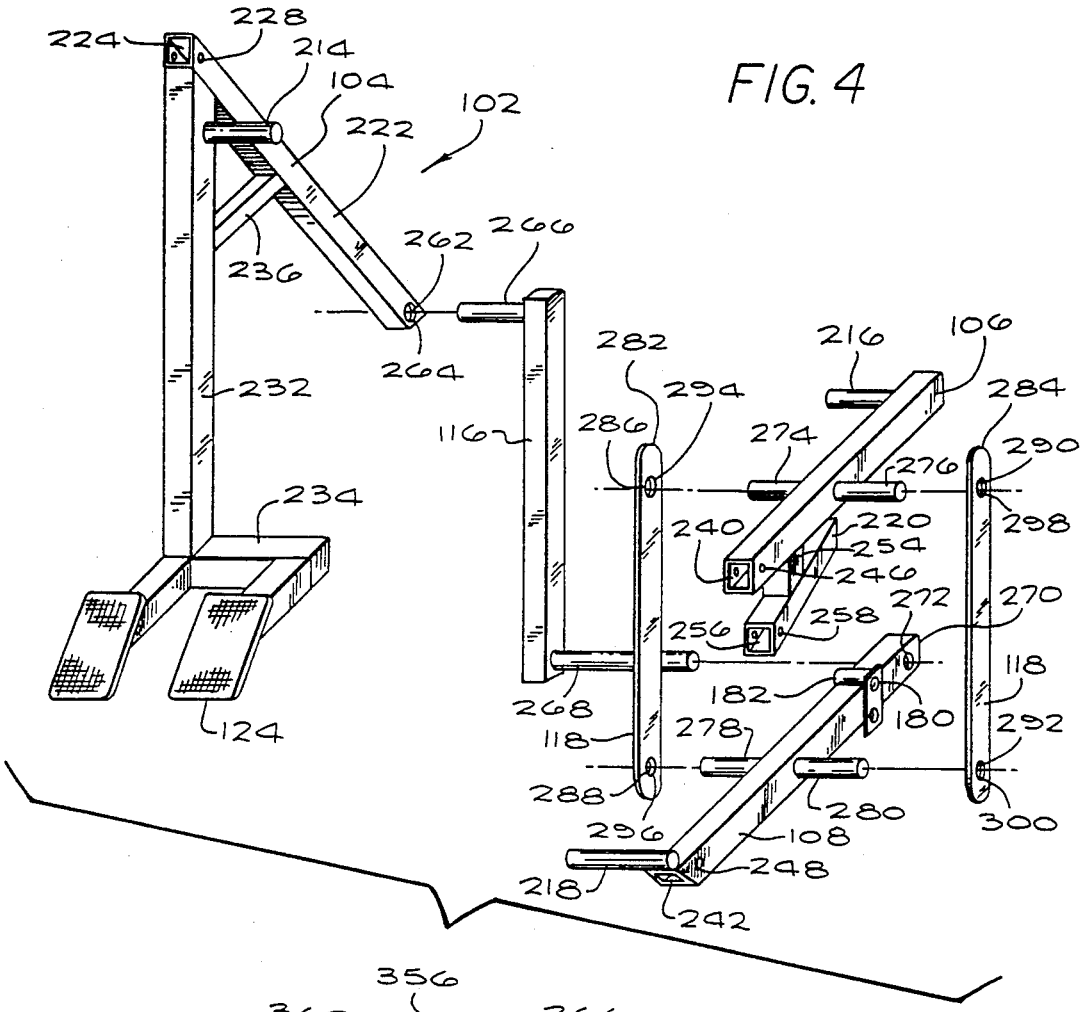
FIG. 4 is an exploded view of the lever arm linkage system of the compact exercise apparatus of FIG. illustrating three lever arms and a pair of swivel bar connectors.

The second stanchion 150 is rigidly connected to the upright stanchion 134 via the cross member 148 and the U-shaped base 132. The second stanchion 150 also includes a curved portion directed from the vertical plane to the horizontal plane. The horizontal portion of the second stanchion 150 includes a penetration for mounting a bracket 158 which supports a first pulley wheel 160. A drive cable, belt, strap, chain or other appropriate device 162 (hereinafter drive cable) is connected to the top of the weight stack 126 via a first mechanical clamp 164 and is then passed through an aperture 166 formed through the horizontal portion of the second stanchion 150. The drive cable 162 is passed over the top of the first pulley wheel 160 and downward in an inclined fashion over the second pulley wheel 156 mounted to cross member 148. The drive cable 162 is then directed vertically downward to the U-shaped base 132 to a third pulley wheel 168. The third pulley wheel 168 is mounted to a base bracket 170 which is secured, as by a bolt 172, to an extension plate 174 connected to a rear extension 176 of the U-shaped base 132 as shown in FIG. 8. The base bracket 170 is free to rotate about the vertical axis of the bolt 172 to maintain alignment of the third pulley wheel 168 with the drive cable 162. The end of the drive cable 162 is then secured by a second mechanical clamp or ring 178 to a terminal end 180 of a resistance arm 182 attached to the third lever arm 108 as shown in FIGS. 2, 3 and 4.

A pair of weight stack guide rods 184 are suspended between the horizontal portion of the second stanchion 150 and the U-shaped base 132 as shown in FIGS. 1 and 8. The top ends of the guide rods 184 are mounted in a pair of receiving holes (not shown) formed in the inboard (underneath) side of the horizontal portion of the second stanchion 150. Likewise, the bottom ends of the guide rods 184 are anchored in corresponding receiving holes 188 formed in the U-shaped base 132 as shown in FIG. 8. Further, the bottom of each guide rod 184 passes through a shock absorbing spring 190 positioned above the respective receiving hole 188 of the U-shaped base 132. The shock absorbing springs 190 act to attenuate the force of the weight stack 126 upon termination of the exercise movement.

The movable weight stack 126 can be comprised of, for example, a plurality of individual weights which can have any desired shape consistent with the operation of the exercise apparatus 100. In the illustrated embodiment 100, the shaped weights are shown as rectangular but other shapes are suitable. Each weight includes a plurality of penetrations 194 for accommodating the pair of guide rods 184 and a third center penetration 196 for accommodating a carriage shaft (not shown). The carriage shaft (not shown) is mounted beneath the movable weight stack 126 and comprises a plurality of holes (not shown) for receiving a selector pin or key 198 for weight selection as is known in the art. The drive cable 162 is connected to the top of the carriage shaft via the first mechanical clamp 164 as shown in FIG. 1. Thus, movement of the third lever arm 108 and thus the drive cable 162 translates the selected weights along the guide rods 184. A protective shield 200 comprised of, for example, plexiglas is secured to the front of the weight stack 126 by a pair of mounting bolts 202 passing through a plurality of brackets 204 and received by penetrations 206 in the U-shaped base 132. The shield 200 includes a window 208 for permitting access to the selector pin 198.

A plurality of pillow blocks forming the first, second and third preset pivot points 110, 112 and 114 are bolted to the upright stanchion 134 and the cross member 148 at a plurality of penetrations 210, 212 and 152 formed therein as shown in FIG. 8. Each pillow block functions to provide a preset pivoted bearing support point for each of a plurality of one inch extension bars 214, 216, 218 welded to the respective lever arms 104, 106, 108 as shown in FIG. 4. Thus, the three pillow block pivot points 110, 112, 114 are mounted to the frame 128 and function to permit rotation of the respective lever arms 104, 106, 108. The mounting of the lever arms 104, 106, 108 to the frame 128 serves to permit rotation through a range of motion about the pivot points 110, 112, 114 and also serves as a plurality of convenient locations to receive the first and second exercise bars 120 and 122 as shown in FIGS. 1–3. The pair of swivel bars 116 and 118 cause each of the three lever arms 104, 106 and 108 to move in a predetermined path when only a single lever arm is operated. The predetermined path of each of the lever arms is defined by an arc where the range of motion of the arc is controlled by the length of the individual lever arm and the position of the respective pivot point.

The individual lever arms accommodate a number of exercise movements. Examples of these movements are listed here for general reference. The first lever arm 104 accommodates the pull down/chin-up, leg press, calf raise and back kick movements. The second lever arm 106 accommodates the shoulder press and squat movements and via an extension arm 220 accommodates the bench press, incline press, shrug, rowing, deadlift, curl, reverse curl, wrist curl and overhead extension movements. Finally, the third lever arm 108 accommodates the parallel bar dip movement. Note that the first lever arm 104 is V-shaped and includes the first extension bar 214 for mounting in the first pillow block pivot point 110 as shown in FIGS. 1–4. Each of the lever arms 104, 106, 108 is shown rectangular in form and is fashioned from, for example, (2″×2″) square steel tubing. However, the lever arms can assume any suitable shape and be comprised of any material consistent with the structural requirements of the compact exercise apparatus 100. The forward end of a top portion 222 of the first lever arm 104 includes a first rectangular socket 224 for receiving an appropriately shaped mounting shaft 226 extending from the first exercise bar 120. The first socket 224 includes a pin hole 228 for receiving a locking pin 230 for locking the exercise bar 120 in place as shown in FIGS. 1 and 4.

A bottom portion 232 of the first lever arm 104 is connected to the top portion 222 as by welding. However, most of the fixed structural connections of the present invention are joined by bolting components together using industrial grade bolt material. This connection method provides convenience in packing and shipping of the exercise apparatus 100. The bottom portion 232, which is vertically descending, terminates in a horizontal U-shaped support 234. Each end of the U-shaped support 234 acts as a mounting point for the set of foot pedals 124 as shown in FIG. 4. The bottom portion 232 is also structurally separated from the top portion 222 by a joint support piece 236 shown in FIGS. 2–4. When force is applied to the foot pedals 124 or when the first exercise bar 120 is inserted into the first socket 224 and pulled upon, for example, in a chin-up motion, the first lever arm 104 rotates about the first pivot point 110. The rotation of the first lever arm 104 about the first pivot point 110 moves the resistance arm 182 of the apparatus 100 via the third lever arm 108 of the linkage system 102. The resistance load of the weight stack 126 is directly connected to the terminal end 180 of the resistance arm 182 as shown in FIGS. 2 and 3.

The second and third lever arms 106 and 108 are each horizontal rectangular pieces as shown in FIG. 4 and include the second and third extension bars 216 and 218 for mounting in the second and third pillow block pivot points 112 and 114 on the frame 128, respectively. The forward ends of the second and third lever arms 106 and 108 include a second socket 240 and a third socket 242, respectively, for receiving either the appropriately shaped mounting shaft 226 of the first exercise bar 120 or an appropriately shaped mounting shaft 244 of the second exercise bar 122. The second and third sockets 240 and 242 each include a pin hole 246 and 248 for receiving respective locking pins 250 and 252 for locking the first and second exercise bars 120 and 122 in place as shown in FIGS. 1 and 4.

The second lever arm 106 includes a vertical extension piece 254 which is welded to the extension arm 220. The extension arm 220 is also rectangularly shaped and comprised of (2"×2") steel tubing and includes a fourth rectangular socket 256 for receiving either of the first or second exercise bars 120 or 122. The fourth rectangular socket 256 also includes a pin hole 258 and a locking pin 260 for securing either exercise bar to the extension arm 220. Since the extension arm 220 is rigidly connected to the second lever arm 106, it also rotates about the second pivot point 112 when operated. By adapting the second lever arm 106 to include the extension arm 220, several of the exercises previously enumerated can be performed. Those exercises include the bench press, incline press, shrug, row and deadlift motions.

When the first exercise bar 120 is removed from the first socket 224 and inserted into the second socket 240 and pushed on, for example, in a shoulder press motion, the second lever arm 106 rotates about the second pillow block pivot point 112 for moving the resistance arm 182 via the third lever arm 108. Likewise, when the removable first or second exercise bars 120 or 122 are inserted into the third socket 242 and either pushed down on in a parallel bar dip manner or pulled up in a curl manner, respectively, the third lever arm 108 is caused to rotate about the third pillow block pivot point 114 for moving the resistance arm 182. Thus, one of the many advantages of the present invention is that the first and second exercise bars 120 and 122 can be removably inserted into any one of the three sockets 224, 240 or 242 for executing an exercise.

The lever arm linkage system 102 is comprised of the first swivel bar 116 and the second swivel bar 118. The first swivel bar 116 connects the first lever arm 104 to the third lever arm 108 as shown in FIGS. 2–4. The terminal end 180 of the resistance arm 182 is affixed to the third lever arm 108 to provide the point of resistance of the apparatus 100 as shown in FIG. 4. The second mechanical clamp or ring 178 is utilized to attach the drive cable 162 to the terminal end 180 of the resistance arm 182 as shown in FIGS. 2 and 3. Thus, the first swivel bar 116 functions to link the first lever arm 104 with the third lever arm 108 so that they operate together. The second swivel bar 118 functions to link the second lever arm 106 to the third lever arm 108 so that they also operate together. It is noted that the second lever arm 106 operates in a direction that is opposite to the first and third lever arms 104 and 108. Further, the second lever arm 106 is not directly connected to the first lever arm 104. However, the second lever arm 106 is connected to the third lever arm 108 via the second swivel bar 118 and the third lever arm 108 is connected to the first lever arm 104 via the first swivel bar 116. Therefore, all of the lever arms 104, 106 and 108 are either directly or indirectly linked together so that operation of any one lever arm necessarily causes the operation of all the lever arms.

The individual lever arms 104, 106 and 108 are adapted to accommodate the swivel bars 116 and 118 as follows. In particular, the first lever arm 104 includes a penetration 262 having a bearing 264 mounted therein to permit rotation of a first stud 266 extending from the first swivel bar 116. A second stud 268 extending from the first swivel bar 116 rotates within a bearing 270 mounted within a penetration 272 of the third lever arm 108. The second lever arm 106 includes a pair of studs 274 and 276 extending therefrom while the third lever arm 108 includes another pair of studs 278 and 280 extending therefrom.

Figure 5:
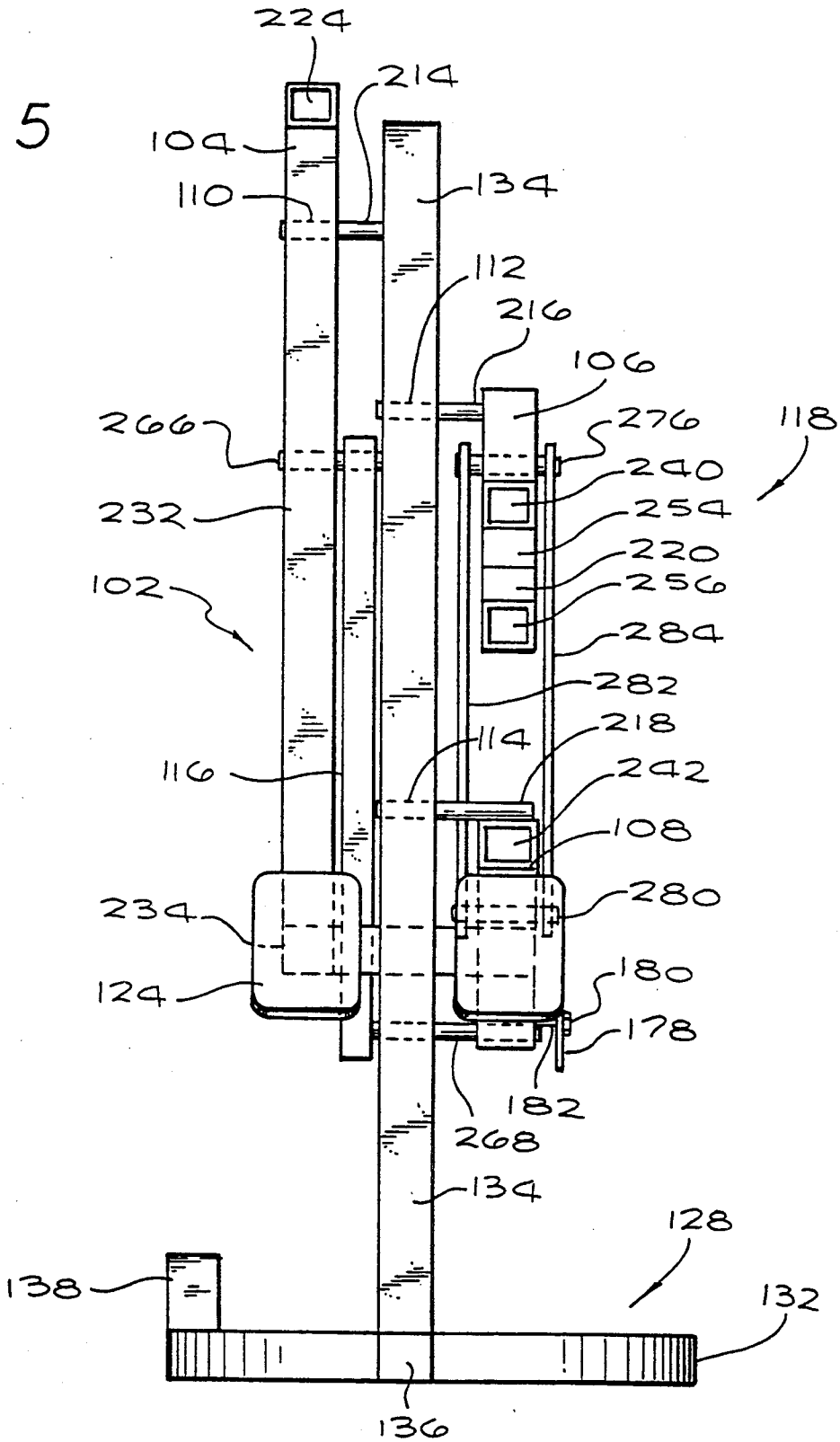
FIG. 5 is a frontal elevational view of the compact exercise apparatus of FIG. 1 showing the interconnections between the lever arms and the swivel bars of the lever arm linkage system.

The second swivel bar 118 is actually comprised of a double bar 282 and 284 as clearly shown in FIGS. 1, 4 and 5. Each double bar 282 and 284 of the second swivel bar 118 includes a penetration at each end. In particular, the first double bar 282 includes penetrations 286 and 288 while the second double bar 284 includes penetrations 290 and 292 best shown in FIG. 4. Each of the first double bar penetrations 286 and 288 accommodate studs 274 and 278, respectively, of the second and third lever arms 106 and 108. Further, each of the second double bar penetrations 290 and 292 accommodate studs 276 and 280, respectively, of the second and third lever arms 106 and 108 as shown in FIG. 4. Each of the first and second double bar penetrations 286, 288, 290 and 292 may include a corresponding bearing 294, 296, 298 and 300, respectively.

Each of the bearings referred to above function to provide a surface for the swivel bars 116 and 118 to rotate about. Further, the end of each of the studs 266, 268, 274, 276, 278 and 280 is then passed through the respective bearing and locked in place in a manner well known in the art. The swivel bars 116 and 118 are then free to rotate with the movement of the respective lever arms. By way of example, the first swivel bar 116 can be fashioned from 1½" square steel tubing while the first and second double bars 282 and 284 of the second swivel bar 118 can be fashioned from (2"×2") flat steel stock.

The use of the swivel bars 116 and 118 to interconnect the lever arms 104, 106 and 108 permits all of the lever arms to move together when any one of the lever arms is operated via either the first or second exercise bars 120 or 122 or via the foot pedals 124. Each of the pillow block pivot points 110, 112 and 114 is fixedly preset on the frame 128 and each of the lever arms 104, 106 and 108 is connected to a respective pivot point and enjoys a field of rotation thereabout. Therefore, each of the lever arms 104, 106 and 108 are preset to the correct angle and height for a particular exercise that the lever arm is utilized to execute. Thus, a novel feature of the present invention is that since the lever arms 104, 106 and 108 are linked together by the swivel bars 116 and 118 and are preset to the correct angle and height through the pivot points 110, 112 and 114, the plurality of exercises can be completed without any required adjustment to the linkage system 102.

Since adjustments to the lever arms 104, 106 and 108 and to the pivot points 110, 112 and 114 are not required, then pulling on the first lever arm 104 or pushing on the second or third lever arms 106 or 108, respectively, or the foot pedals 124 results in all the lever arms and pivot points operating together. The interconnected lever arms 104, 106 and 108 further cause each of the lever arms to move in a predetermined path when only a single lever arm is moved. The predetermined path is an arc, the locus of which is determined by the length of the particular lever arm and the position of the pivot point. It is the interconnected feature of the swivel bars 116 and 118 that permits the individual lever arms to operate when moved and to engage the resistance of the weight stack 126 notwithstanding which lever arm is moved. Further, the preset pivot points 110, 112 and 114 permit any of the lever arms to be connected to the resistance arm 182 and also permits an equivalent weighted load to be applied to any of the lever arms.

These advantageous features of the present invention save time which was normally spent adjusting prior art machines and permits a plurality of exercises to be completed in a nominal time period. A further advantage is derived since the present invention enables an individual having a busy schedule to complete a general exercise program at regular intervals leading to improved fitness. An additional advantage is that the positioning of the lever arms in cooperation with the preset pivot points enables the proper biomechanical and kinesiological function adhering to a particular exercise to which the apparatus was designed to perform. Thus, the present invention permits the exercises to be performed properly which minimizes the risk of injury to an individual utilizing the apparatus 100. Finally, the unitary operation of the interconnected lever arms permits the execution of different exercises in a space economical manner.

The seat station 130 includes the adjustable main shaft 146 which is employed to connect the entire seat station 130 to the apparatus frame 128 as shown in FIG. 8. The U-brace 144 includes a pair of penetrations 304 and 306. The penetration 304 in the U-brace 144 is aligned with the penetration 141 formed in the base member 136. A fastener such as a bolt (not shown) is passed through the aligned penetrations 141 and 304 for removably connecting the seat section 130 to the frame 128. The main shaft 146 further comprises a vertical extension 308 having a penetration 310 therethrough. A cylindrical rod 312 is then passed through the penetration 310 and a pair of roller pads 314 are mounted onto the cylindrical rod 312 for supporting an individuals feet during the parallel bar dip movement on the third lever arm 108 and during the sit-up movement. An opposite end 316 of the main shaft 146 terminates in a bracket 318 connected to a floor mounted T-block 320 in a typical pin-in-hole arrangement as shown in FIGS. 1 and 8.

The seat station 130 also includes an adjustable seat support 322 which comprises a twin neck portion 324 mounted atop an adjustable slide tube 326 that passes over the main shaft 146 as shown in FIG. 8. The slide tube 326 exhibits a penetration 328 that when aligned with corresponding penetrations 330 in the main shaft 146 permits the passage of a popper pin 332 (see FIGS. 1 and 2) therethrough to lock the seat support 322 in place. The seat station 130 incorporates a hinged construction as now disclosed. That portion of the seat station 130 that provides seat and back support is comprised of two sections 334 and 336 which are identical as shown in FIGS. 2 and 8. The seat sections 334 and 336 each include a pair of runners 338 mounted on the back of a board like support piece 340. The pair of runners 338 are each pivotably secured via an end penetration 339 to a cylindrical fitting 341 on the top center surface of the seat support 322 as shown in FIG. 2.

Each of the pair of runners 338 also includes a penetration 342 for connecting to and supporting a pivotable weight-bearing flanged brace 344 at a proximal end with a bolt. The distal end of the flanged brace 344 is pivotably adjustable for securing against one of a plurality of ridges 346 welded to the top surface of the seat support 322 as shown in FIGS. 1–3 and 8. The ridges 346 are distributed on the seat support 322 on both sides of the seat sections 334 and 336 and are affixed at an acute angle to provide a pocket 348 for receiving the flanged brace 344. Each of the seat sections 334 and 336 also includes a high density foam pad 350 covered, for example, with naugahyde upholstery and mounted to the board like support piece 340 in a manner well known in the art for providing a cushioned seat. Therefore, by adjusting the slide tube 326 along the main shaft 146 and by pivotably adjusting the two seat sections 334 and 336 by positioning the flanged brace 344 against one of the ridges 346, the seat station 130 is adaptable to a specific exercise and an individual user. Although each of the elements of the seat station 130 are shown as rectangular in shape, any configuration and structural material can be employed which is suitable for the application.

Figure 9:
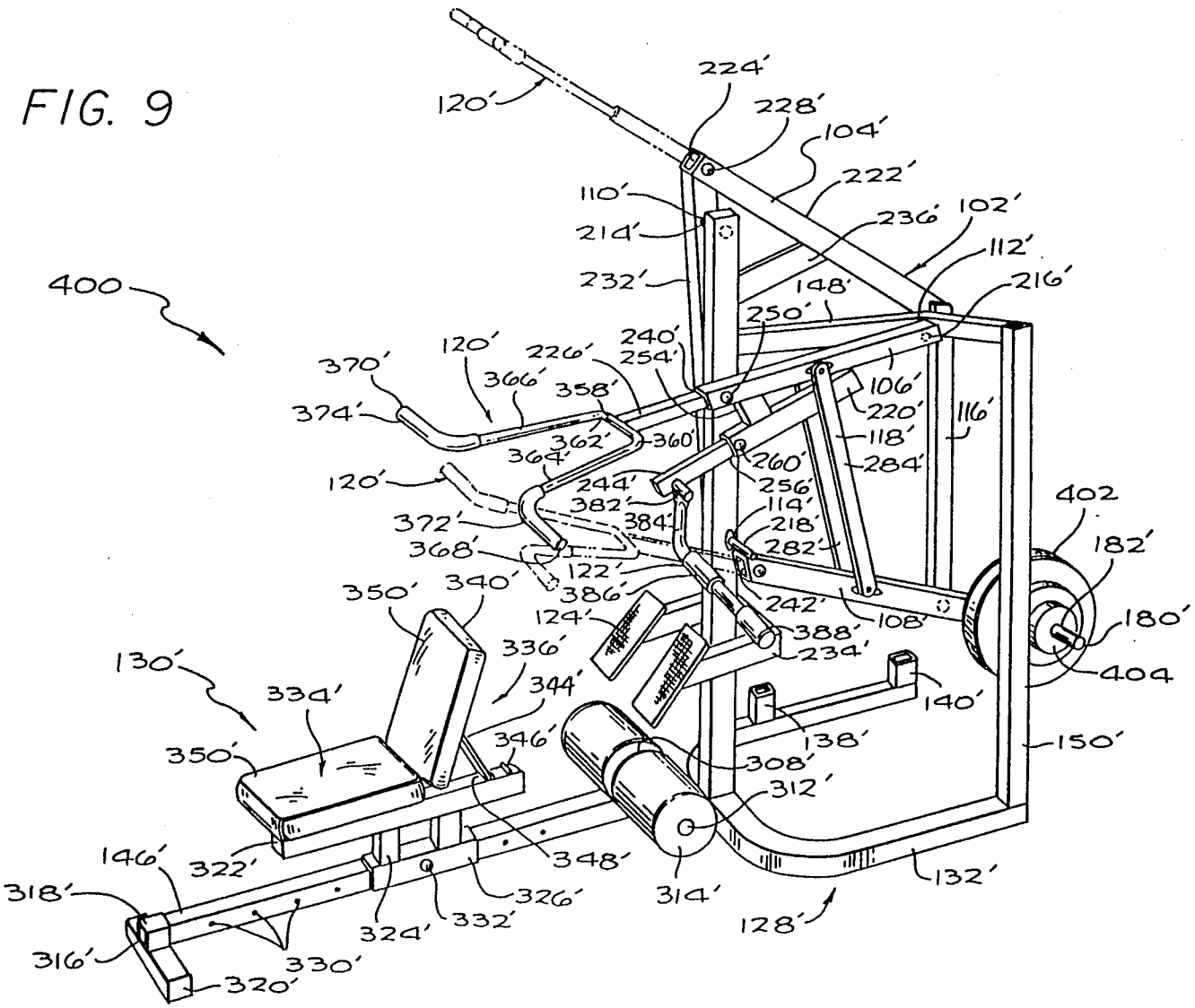
FIG. 9 is a perspective view of an alternative embodiment of the compact exercise apparatus in accordance with the present invention showing the lever arm linkage system cooperating with another source of variable resistance and several alternative positions of the exercise bars.

For those exercise movements that require the use of the seat station 130, it is noted that the seat station is adjusted so that a user faces towards the frame 128 when the foot pedals 124 and the first and third lever arms 104 and 108 are utilized. This position is illustrated in FIG. 1. An example of such exercise movements would include leg presses which utilize the foot pedals 124 and chin-up and parallel bar dip movements which utilize the first and third lever arms 104 and 108, respectively. However, the seat station 130 is adjusted so that a user faces away from the frame 128 when the second lever arm 106 is utilized, for example, for the shoulder press movement. This position is illustrated in FIG. 9 which is discussed hereinbelow. Thus, the seat station 130 is reversible.

The reversibility of the seat station 130 is accomplished by pivoting each of the seat sections 334 and 336 about the respective bolt passing through the respective end penetration 339. By repositioning the flanged brace 344 connected to the pair of runners 338, the angle of each seat section 334 and 336 can be altered as shown in FIG. 2. Further, both seat sections 334 and 336 can be adjusted into a flat position as shown in FIG. 3 to accommodate the bench press exercise movement executed with the extension arm 220 and the first exercise bar 120 and also to place the seat station 130 in the stowage position.

The penetration 304 of the U-brace 144 mounted at the end of the adjustable main shaft 146 of the seat station 130 interfaces with the penetration 141 of the base member 136 as is clearly shown in FIG. 2. This construction permits the seat station 130 to be rotated from the horizontal position when in use (see FIGS. 1 and 2) to the vertical stowage position (see FIG. 3). Prior to rotating the seat section 130 into the vertical position, the popper pin 332 is removed and the slide tube 326 is moved to the position closest to the end 316 of the main shaft 146. The popper pin 332 is then reinserted into a penetration 330 on the main shaft 146. This action prevents the foot pedals 124 from blocking the seat section 336. Also, prior to placing the seat station 130 into the vertical position, each of the flange braces 344 are released and the seat sections 334 and 336 are laid in the flat position.

A popper pin 354 located in penetration 306 of the U-brace 144 shown in FIGS. 2 and 3 is removed. Then the main shaft 146 is lifted into the vertical position as from the floor mounted T-block 320. The seat station 130 is rotated about the bolt or pin positioned through the respective penetrations 141 and 304 of the base member 136 and the U-brace 144, respectively. After the main shaft 146 is in the vertical position, the popper pin 354 is reinserted through penetrations 142 and 306 of the base member 136 and the U-brace 144, respectively. Under these conditions, the popper pin 354 locks the main shaft 146 in the vertical position for convenient stowage when the exercise apparatus 100 is not in use as shown in FIG. 3. By removing the popper pin 354 from the penetrations 142 and 306, the main shaft 146 can be released from the vertical stowage position and lowered to the floor level. The popper pin 354 is then reinserted into penetration 306 of the U-brace 144 and the exercise apparatus 100 is then ready to use.

Figure 6:
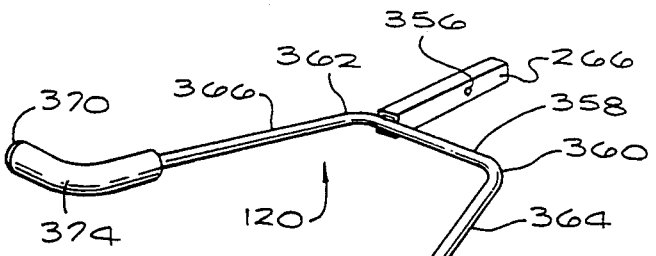
FIG. 6 is a perspective view of a removable exercise bar utilized to perform exercises with the compact exercise apparatus of FIG. 1.
Figure 7:
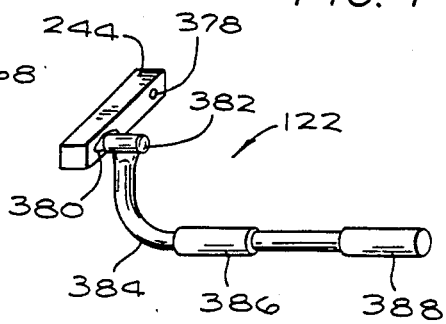
FIG. 7 is a perspective view of another removable exercise bar utilized to perform exercises with the compact exercise apparatus of FIG. 1.

The first and second exercise bars 120 and 122 are shown in FIGS. 6 and 7, respectively. The first exercise bar 120 includes the mounting shaft 226 having a penetration 356 formed therein for receiving a popper pin. The popper pin is utilized to lock the exercise bar 120 into any one of the slots 224, 240, 242 or 256 shown in FIG. 4. The popper pin can include any of the pins 230, 250 or 260 shown in FIG. 1. The mounting shaft 226 may be comprised of (2"×2") square steel tubing and interfaces with a cross bar 358 in an orthogonal manner as shown in FIG. 6. The cross bar 358 includes a pair of ends 360 and 362 each of which are shaped to curve at an angle acute with the axis of the cross bar 358 to form a pair of diverging bars 364 and 366 in a direction opposite to the mounting shaft 226. The diverging bars 364 and 366 are each then angled outward to form a pair of handles 368 and 370 best shown in FIG. 6. The pair of handles 368 and 370 are shown as cylindrical in shape for more easily adapting to the palm of the hand and may include handle grips 372 and 374.

Note that the mounting shaft 226 is shown off-center in FIG. 6. The off-center construction of the mounting shaft 226 is due to the construction of the frame 128 the three lever arms 104, 106 and 108, and the extension arm 220. Further, the off-center construction of the mounting shaft 226 permits access to the preset pivot points 110, 112 and 114 and also enables the handles 368 and 370 to be aligned with the seat station 130 and the frame 128 for proper exercise movements. During idle periods, the first exercise bar 120 can be removed from the locked position in any one of the sockets 224, 240, 242 or 256 and placed in the storage slot 138 as shown in phantom in FIG. 1 and in FIGS. 5 and 8.

The second exercise bar 122 includes the mounting shaft 244 which is fitted into either socket 240 or 256 of the second lever arm 106 for use. The mounting shaft 244 includes a penetration 378 therein for receiving the popper pin 250 or 260 for securing the second exercise bar 122 to either socket 240 or 256. The mounting shaft 244 may be comprised of (2"×2") square steel tubing. A bearing 380 is mounted at a distal end of the mounting shaft 244 for permitting the rotation of a one inch solid bar shaft 382. A curling bar 384 is connected to the one inch solid bar shaft 382 in a manner well known in the art such as by welding. The curling bar 384 is shaped so that a major portion of the length is parallel to the floor level. A pair of curling grips 386 and 388 are wrapped about the curling bar 384.

In operation, the curling bar 384 utilizes the second pivot point 112 and socket 240 of the second lever arm 106 or socket 256 of the extension arm 220 depending upon the specific exercise being performed and the height of the user. The bearing 380 permits the curling bar 384 to swivel and to act as a hand crank permitting the user to exercise the biceps and forearm muscles. During idle periods, the second exercise bar 122 can be removed from the locked position in either of the sockets 240 or 256 and placed in the storage slot 140 as shown in phantom in FIG. 1 and in FIG. 8.

Each of the exercise movements performed on the compact exercise apparatus 100 are executed using either the foot pedals 124, the first exercise bar 120 or the second exercise bar 122. The major exercises performed by pushing on the foot pedals 124 connected to the first lever arm 104 include the leg press, calf raise and back kick movements. The major exercises executed by pushing on the first exercise arm 120 attached to the first, second or third lever arms 104, 106 or 108, respectively, or the extension arm 220 include the shoulder press, bench press, incline press, parallel bar dip and squat movements while the pull-down/chin-up, deadlift and shrug movements are accomplished by pulling on the first exercise bar 120.

Further, the main exercises completed by employing the second exercise bar 122 attached to the second lever arm 106 or the extension arm 220 include the upright row, arm curl, reverse curl, wrist curl and overhead extension movements. Abdominal exercises are accomplished by first adjusting the seat sections 334 and 336 into a flat bench as previously described. Then, the individual sits on foam pads 350 facing the frame 128. The individual's feet are then anchored underneath the roller pads 314 at which point the sit-up exercise can be performed. By reversing the position of the body to face away from the frame 128 and holding onto part of the frame 128, several other abdominal exercises can be accomplished.

An alternative embodiment of the present invention is disclosed in FIG. 9. In this instance, the alternative embodiment of the compact exercise apparatus 400 in FIG. 9 also is of the type that includes a lever arm linkage system similar to that of the compact exercise apparatus 100 of FIGS. 1–8. Parts of the compact exercise apparatus 400 of FIG. 9 which find substantial correspondence in structure and function to those parts of the exercise apparatus 100 shown in FIGS. 1–8 are designated with corresponding but primed reference numerals.

The compact exercise apparatus 400 is very similar in construction and operation to the compact exercise apparatus 100 of the preferred embodiment. To that extent, the apparatus 400 includes a duplicate lever arm linkage system 102' having first, second and third lever arms 104', 106' and 108' operating through a plurality of corresponding pillow block pivot points 110', 112' and 114'. Further, the first, second and third lever arms are interconnected in a duplicate manner by first and second swivel bars 116' and 118'. Additionally, each of the options of a first exercise bar 120', a second exercise bar 122" and a pair of foot pedals 124' are included to execute the plurality of exercise movements through the individual lever arms. The apparatus 400 also comprises a seat station 130' which is connected to a slightly modified frame 128' as shown in FIG. 9.

Each of the lever arms 104', 106' and 108' and a duplicate extension arm 220' also include an appropriately shaped socket 224', 240', 242' and 256' for the insertion of the first or second exercise bar 120, or 122' therein. The seat station 130' is also duplicate to the seat station described in the preferred embodiment. Although not clearly shown, a stowage system for locking the seat in the vertical position duplicate to that described in the preferred embodiment is also incorporated into apparatus 400. The construction of the first and second exercise bars 120' and 122' and the foot pedals 124' is the same as described with reference to the preferred embodiment.

A major distinction between the alternative embodiment of the apparatus 400 and the preferred embodiment is that the weight stack and associated pulley assembly and drive cable which were connected to the terminal end of the resistance arm have been removed. The point of resistance of the apparatus 400 continues to be located at a terminal end 180' of a resistance arm 182' which is now positioned at the end of the third lever arm 108'. However, a plurality of free weights 402 which are positioned and locked onto the resistance arm 182' by a collar 404 are moved directly by the linkage system 102' when any one of the lever arms 104', 106' or 108' are operated (see FIG. 9).

The absence of the weight stack and associated pulley assembly and drive cable permit a modification to the frame 128'. In particular, a horizontal portion of a second stanchion 150' present in the apparatus 100 has been removed. A U-shaped horizontal base 132' has only been slightly modified to eliminate various penetrations in the frame 128' that previously supported the, now nonexistent, weight stack. Thus, the U-shaped horizontal base 132' of the alternative embodiment 400 now appears as shown in FIG. 9.

As with all construction of the present invention, the compact exercise apparatus 400 is designed to permit the use of the lever arms and preset pivot points to eliminate any adjustments to the linkage system 102' and to emulate the proper biomechanical and kinesiological function adhering to a particular exercise. The remainder of the construction of the compact exercise apparatus 400 is the same as that construction disclosed in accordance with the apparatus 100 of the preferred embodiment. Further, each of the plurality of exercises previously discussed is completed on the exercise apparatus 400 in a manner duplicate to that described in the preferred embodiment.

Each of the advantages recited with respect to the preferred embodiment also apply to the exercise apparatus 400 of the alternative embodiment. Since adjustments to the lever arms 104', 106' and 108' and the pivot points 110', 112' and 114' are not required, then operation of the first, second or third lever arms 104', 106' or 108' or the foot pedals 124' results in all the lever arms and pivot points operating together. The interconnected lever arms further cause each of the lever arms and pivot points operating together. The interconnected lever arms further cause each of the lever arms to move in a predetermined arc path when only a single lever arm is operated. It is the interconnected feature of the swivel bars 116' and 118' that permits the individual lever arms to operate when moved and to engage the resistance notwithstanding which lever arm is moved. Further, the preset pivot points 110', 112∝ and 114' permit any of the lever arms to be connected to the resistance arm 182' and also permits an equivalent weighted load to be applied to any of the lever arms.

These advantageous features of the present invention save time normally spent adjusting other prior art machines and permits a plurality of exercises to be completed in a nominal time period, enables an individual having a busy schedule to complete a general exercise program at regular intervals leading to improved fitness, and enables the proper biomechanical and kinesiological function adhering to a particular exercise to which the apparatus was designed to perform minimizing risk of injury.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

What is claimed is:

1. A compact exercise apparatus for use in performing a plurality of exercises comprising:

a resistive load;

means for supporting said load;

removable means for moving said load from a first position to a second position; and linkage means disposed between said removable moving means and said load, said linkage means including first, second and third interconnected pivotally operably lever arms, said first lever arm being directly connected to said third lever arm through a first swivel bar and said second lever arm being directly connected to said third lever arm through a second swivel bar, wherein said removable moving means is mountable to each of said plurality of lever arms to provide a plurality of activation points each rotating about a separate lever arm pivot point wherein operation of any one of said activation points simultaneously operates each of said plurality of lever arms for enabling the proper biomechanical and kinesiological movement of each of said exercises and for moving said load from said first position to said second position.

2. The compact exercise apparatus of claim 1 wherein said supporting means includes a frame structure.

3. The compact exercise apparatus of claim 1 wherein said resistive load includes a pulley driven weight stack.

4. The compact exercise apparatus of claim 1 wherein said resistive load includes a weight positioned at a point of resistance located on said linkage means.

5. The compact exercise apparatus of claim 1 wherein said removable moving means comprises an exercise bar.

6. The compact exercise apparatus of claim 1 wherein said removable moving means includes a leg press shaft connected to said first lever arm of said lever arms.

7. The compact exercise apparatus of claim 1 wherein said first, second and third interconnected lever arms are each mounted to said supporting means.

8. The compact exercise apparatus of claim 1 further including an adjustable seat assembly.

9. The compact exercise apparatus of claim 1 wherein said supporting means further includes an extension for mechanically communicating with a U-shaped bracket of an adjustable seat assembly.

10. The compact exercise apparatus of claim 9, wherein said U-shaped bracket of said adjustable seat assembly is rotatable about said supporting means extension for locking said seat assembly in a storage position.

11. The compact exercise apparatus of claim 1 wherein said second lever arm is rotated about a pivot point in a direction opposite to the direction of rotation of said first and third lever arms.

12. A compact exercise apparatus for use in performing a plurality of exercises comprising:

a resistive load;

a frame structure for supporting said load;

removable means for moving said load from a first position to a second position; and a lever arm linkage arrangement disposed between said removable moving means and said load, said linkage arrangement including first, second and third interconnected lever arms operating through a corresponding plurality of pivot points, said first lever arm being directly connected to said third lever arm through a first swivel bar and said second lever arm being directly connected to said third lever arm through a second swivel bar, wherein said removable moving means is mountable to each of said plurality of lever arms to provide a plurality of activation points each rotating about a separate one of said pivot points wherein operation of any one of said activation points simultaneously operates each of said plurality of lever arms for enabling the proper biomechanical and kinesiological movement of each of said exercises and for moving said load from said first position to said second position.

13. The compact exercise apparatus of claim 12 wherein said first, second and third interconnected lever arms mounted to said supporting means.

14. The compact exercise apparatus of claim 12 wherein said second lever arm is rotated about a pivot point in a direction opposite to the direction of rotation of said first and third lever arms.

15. A method for constructing a compact exercise apparatus for use in performing a plurality of exercises, said method comprising the steps:

providing a resistive load;

connecting said resistive load to a frame structure for support;

providing a removable exercise bar for moving said load from a first position to a second position;

disposing a linkage arrangement between said removable exercise bar and said load, said linkage arrangement including first, second and third lever arms;

connecting aid first lever arm directly to said third lever arm through a first swivel bar and said second lever arm to said third lever arm through a second swivel bar; and, presetting the positions of said plurality of lever arms at a corresponding plurality of pivot points mounted to said frame structure for operating said plurality of lever arms therethrough, said removable exercise bar connectable to each of said lever arms to provide a plurality of activation points each rotating about a separate pivot point wherein operation of any one of said activation points simultaneously operates each of said plurality of lever arms for enabling the proper biomechanical and kinesiological movement of each of said exercises and for moving said load from said first position to said second position.

16. The method of claim 15 further including the step of rotating said second lever arm about a pivot point in a direction opposite to the direction of rotation of said first and third lever arms.

* * * * *

UNITED STATES PATENT AND TRADEMARK OFFICE

CERTIFICATE OF CORRECTION

PATENT NO. : 5,217,422

DATED : June 8, 1993

INVENTOR(S) : Kenneth J. Domzalski

It is certified that error appears in the above-identified patent and that said Letters Patent is hereby corrected as shown below:

Column 3, line 8, after "FIG." insert -- 1 --.

Column 13, line 44, delete "The intercon-".

Column 13, line 45, delete "nected lever arms further cause each of the lever arms".

Column 13, line 46, delete "and pivot points operating together".

Column 13, line 53, change "112" to -- 112' --.

Claim 13, line 3, after "arms" insert -- are each --.

Claim 15, line 13, change "aid" to -- said --.

Signed and Sealed this

Eleventh Day of January, 1994

Bruce Lehman

*Attest:*

BRUCE LEHMAN

*Attesting Officer*

*Commissioner of Patents and Trademarks*